United States Patent [19]

Linder et al.

[11] Patent Number: 4,740,355

[45] Date of Patent: Apr. 26, 1988

[54] ALUMINUM ALLOY FOR THE PRODUCTION OF SACRIFICIAL ANODES FOR ANODES FOR CATHODIC CORROSION PROTECTION

[75] Inventors: Bjorn Linder, Landskrona, Sweden; Oskar Klinghoffer, Soborg, Denmark

[73] Assignee: Bergsoe Anti Corrosion International AB, Landskrona, Sweden

[21] Appl. No.: 801,756

[22] Filed: Nov. 26, 1985

[30] Foreign Application Priority Data

Nov. 30, 1984 [SE] Sweden ..... 8406051

[51] Int. Cl.[4] ..... C22C 21/00

[52] U.S. Cl. ..... 420/540; 420/531

[58] Field of Search ..... 420/540, 531; 148/437, 148/438

[56] References Cited

U.S. PATENT DOCUMENTS 3,388,987 6/1968 Bailey ..... 420/540

*Primary Examiner*—Richard O. Dean

*Attorney, Agent, or Firm*—Burgess, Ryan & Wayne

[57] ABSTRACT

Sacrificial anodes for cathodic corrosion protection are produced by alloying commerical aluminum having an iron content of up to 0.5% by weight with 0.01–0.5% by weight of manganese and preferably 3.5–6% by weight of zinc and 0.01–0.05% by weight of indium.

3 Claims, No Drawings

ALUMINUM ALLOY FOR THE PRODUCTION OF SACRIFICIAL ANODES FOR ANODES FOR CATHODIC CORROSION PROTECTION

The present invention relates to an aluminium alloy for the production of sacrificial anodes for cathodic corrosion protection.

In the production of galvanic anodes, so-called sacrificial anodes, for cathodic corrosion protection, the starting material used today is aluminium of high purity, for example a percentage purity of 99.85–99.99%. Aluminium of such purity is expensive, and for a long time past it has therefore been tried to produce anodes of aluminium of lower purity, but without success. From the point of view of economy, it would therefore be advantageous if one could use conventional commercial aluminium, i.e. aluminium having an iron content of up to 0.5% by weight, and it therefore is the object of the present invention to provide an aluminium alloy based on commercial aliminium and intended for sacrificial anodes. This object is achieved in that an alloy is produced which contains, based on the total weight of the alloy, about 0.01–1.0% by weight of manganese, 0—about 20% by weight of zinc, and 0—about 0.1% by weight of indium, the balance being commercial aluminium having an iron content of up to about 0.5% by weight.

This alloy has a negative electrochemical potential and low inherent corrosion and therefore constitutes an excellent anode material. Anodes produced from this alloy are much cheaper than anodes made of aluminium of high percentage purity, and furthermore have high current efficiency and a constant electrode potential during their life to impart a continuous protection to metal objects with which they are connected.

Although the addition of zinc and indium may be dispensed with in the alloy, improved anode characteristics will be obtained with these additives. The zinc constituent imparts to the anode the desired electrode potential, and it has been found that zinc in an amount of less than 1% by weight does not give the desired characteristics, and that an addition of more than 20% by weight is possible, although unsuitable. The zinc additive is suitably selected within the range 2–7% by weight, and preferably within the range 3.5–6% by weight. The indium additive makes it possible to maintain the desired anode potential and high current efficiency. The additive is selected within the range 0.005–0.1% by weight, preferably 0.01–0.07% by weight, and most preferably 0.01–0.05% by weight. Higher amounts of indium have the opposite effect.

The addition of manganese is important and is needed to bind the iron impurities which occur in commercial aluminium and which normally amount to about 0.2% by weight, although higher values may occur. Unless this amount of iron is neutralised, the current efficiency of the anodes will be drastically reduced because iron and aluminium form an intermetallic compound $Al_3Fe$ which is cathodic in relation to the matrix, and therefore part of the anode material is utilised to protect first of all the matrix. The addition of manganese results in the formation of a further intermetallic compound, i.e. $Al_3Fe_xMn_y$, which, in contrast to the first-mentioned compound, has approximately the same potential as the matrix, whereby the above-mentioned negative effect is avoided. The manganese additive may amount to 0.01–1.0% by weight, but an improved effect is obtained with an addition of 0.01–0.5% by weight, and an even higher effect with an addition of between 0.10 and 0.20% by weight. A manganese content exceeding 1.0% by weight has a negative effect on the anode potential.

Commercial aluminium may also have a copper content of up to 0.1% by weight, but this presents no problem in zinc, indium and manganese alloys.

The invention will now be described in more detail below, reference being had to the following example.

An alloy was produced by melting ingots of commercial aluminium having an iron content of about 0.18% by weight, and 4.1% by weight of zinc, 0.030% by weight of indium and 0.20% by weight of manganese, based upon the total weight of the alloy, were added. The melt was stirred to provide a homogeneous mixture from which a number of anodes in the form of so-called dock anodes, model B.A.C. 280 HAL (about 28 kg net) were cast. These anodes were immersed in the water in the port of Korsör, Denmark, adjacent at 50 m long metal sheet piling to protect it. After that, the current delivery from all anodes as well as the anode potentials were continuously measured during operation. Underwater investigations by divers were carried out at three occasions. The experiment was discontinued after six months, and all anodes were taken out of the water. The visual and quantitative examinations were both highly positive. All anodes had been consumed to the same extent, and there was no sign of passivation. The consumption pattern naturally varied from one anode to the other, and this applies also to the weight loss which was used for calculating the current efficiency of the anodes. Generally, it can be concluded from this experiment that the efficiency of the alloy is higher than 80%, which corresponds to a capacity in excess of 2380 Ah/kg or a life exceeding 3.68 kg/A and year.

To check the above results, samples were cut from the anodes and sent to the laboratory for so-called "galvanostatic short term test", in order to determine the efficiency and operational potentials of the anodes. This test which has been accepted by, inter alia, the Norwegian classification society Det Norske Veritas, confirmed the above figures. Thus, the operational potentials of the anodes were found to lie between −1090 and −1118 mV vs. SCE (saturated calomel electrode) while the efficiency was measured at 82%, corresponding to 2440 AH/kg or 3.59 kg/A and year.

What we claim and desire to secure by Letters Patent is:

1. An aluminium alloy for the production of sacrificial anodes for cathodic corrosion protection, consisting essentially of, based upon the total weight of the alloy, 0.01% to 1.0% by weight of manganese, 1–20% by weight of zinc, and 0.005–0.1% by weight of indium, the balance being commercial aluminium having an iron content of up to about 0.5% by weight and a copper content of up to 0.1% by weight.

2. An aluminium alloy as claimed in claim 1, consisting essentially of, based upon the total weight of the alloy, 2–7% by weight of zinc, 0.01–0.07% by weight of indium, and 0.01–0.5% by weight of manganese, the balance being commercial aluminium having an iron content of up to 0.5% by weight and a copper content of up to 0.1% by weight.

3. An aluminium alloy as claimed in claim 1, consisting essentially of, based upon the total weight of the alloy, 3.5–6% by weight of zinc, 0.01–0.05% by weight of indium, and 0.01–0.5% by weight of manganese, the balance being commercial aluminium having an iron content of up to 0.5% by weight and a copper content of up to 0.1% by weight.

* * * * *